US008641544B2

(12) United States Patent
O'Toole et al.

(10) Patent No.: US 8,641,544 B2
(45) Date of Patent: Feb. 4, 2014

(54) INTERACTIVE WATER PLANE APPARATUS

(76) Inventors: Michael O'Toole, Parma, OH (US); Andrew Ratcliff, Cleveland, OH (US)

( * ) Notice: Subject to any disclaimer, the term of this patent is extended or adjusted under 35 U.S.C. 154(b) by 259 days.

(21) Appl. No.: 13/112,300

(22) Filed: May 20, 2011

(65) Prior Publication Data

US 2011/0312430 A1 Dec. 22, 2011

Related U.S. Application Data

(60) Provisional application No. 61/347,024, filed on May 21, 2010.

(51) Int. Cl.
*A63G 9/00* (2006.01)
*A63G 31/00* (2006.01)

(52) U.S. Cl.
USPC ..... 472/118; 472/128

(58) Field of Classification Search
USPC ..... 472/117–125, 128; 239/279, 289
See application file for complete search history.

(56) References Cited

U.S. PATENT DOCUMENTS 3,539,181 A 11/1970 Larsen
4,084,812 A 4/1978 Melrose et al.
4,498,627 A * 2/1985 Arginsky ..... 239/279
5,219,315 A 6/1993 Fuller et al.
5,378,197 A 1/1995 Briggs
5,741,189 A 4/1998 Briggs
5,820,471 A 10/1998 Briggs
5,862,990 A * 1/1999 White ..... 239/289
6,050,872 A 4/2000 Cahill et al.
6,375,578 B1 4/2002 Briggs
6,482,096 B1 11/2002 Rieber et al.
6,916,249 B2 * 7/2005 Meade ..... 472/119
8,047,925 B2 * 11/2011 Burgaard et al. ..... 472/118

OTHER PUBLICATIONS http://www.youtube.com/watch?v=PjArsPc7xol Video of waterfall at Jeep portion of North American Auto Show, Jan. 17, 2007
http://www.holeinthedonut.com/2008/08/31/fascinating-japanese-water-writer/ Video of Japanese water writer.
http://www.bestadsontv.com/ad/29199/Hyundai-Fluidic-Sculpture Video of television ad for Hyundai Motor Company illustrating waterfall.
http://www.campaignbrief.com/2010/05/innoceans-hyundai-i45-driven-b.html Article about Hyundai television ad with waterfall, May 22, 2010.

* cited by examiner

*Primary Examiner* — Kien Nguyen
(74) *Attorney, Agent, or Firm* — Tarolli, Sundheim, Covell & Tummino LLP

(57) ABSTRACT

An interactive apparatus includes a frame that defines an interior region. A swing is secured to the frame and moves into and out of the interior region. At least one fluid delivery system is secured to the frame for directing a plane of fluid into the interior region of the frame. The fluid delivery system includes a plurality of flow regulating elements for selectively controlling the cross-section of the fluid plane.

16 Claims, 10 Drawing Sheets

FIG. 7
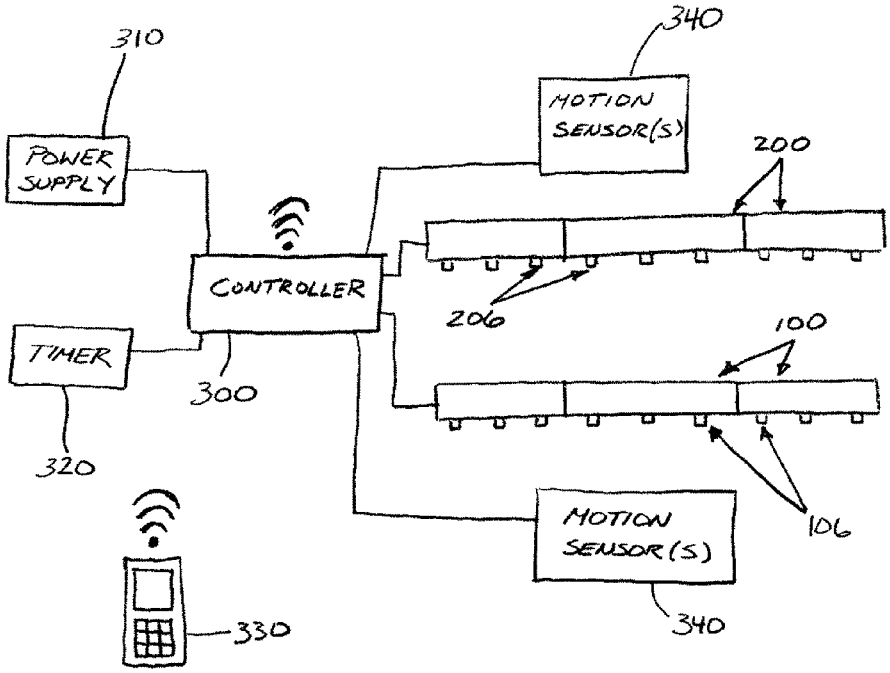
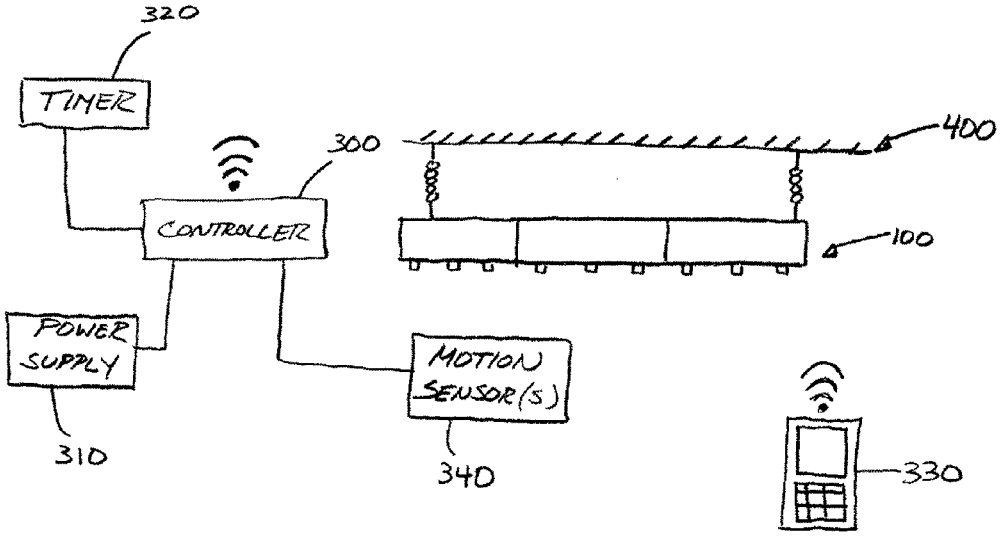
FIG. 11

INTERACTIVE WATER PLANE APPARATUS

RELATED APPLICATION

This application claims the benefit of Provisional Application Ser. No. 61/347,024, filed May 21, 2010, the entirety of which is incorporated herein by reference in its entirety.

TECHNICAL FIELD

The invention relates to an interactive apparatus and, more specifically, relates to a swing set having at least one interactive fluid plane through which users of the swing set pass and which can be controlled through a mobile device.

BACKGROUND

Playground equipment and, in particular, swing sets are known in the art. In use, the user swings back and forth on the swing into and out of the interior of the swing set for amusement. The level of amusement for swingsets, however, is limited because the swing does not react to the user. Additionally, since swing sets are typically constructed outdoors so that heat from the sun can limit the amount of time spent on the swing set. There is therefore a need in the art for a swing set that increases the level of amusement by interacting with the swing user.

SUMMARY OF THE INVENTION

In accordance with the present invention a playground apparatus includes a frame that extends along an axis and defines an interior region. A swing is secured to the frame and moves into and out of the interior region. At least one fluid delivery system is secured to the frame and directs a plane of fluid into the interior region of the frame. The fluid delivery system includes a plurality of flow regulating elements for selectively controlling the cross-section of the fluid plane.

In accordance with another aspect of the present invention, an interactive apparatus includes a frame that extends along an axis and defines an interior region. A swing is secured to the frame and is movable into and out of the interior region. A first fluid delivery system is secured to the frame and directs a first plane of fluid into the interior region of the frame. The first fluid delivery system includes a plurality of flow regulating elements that are actuatable for selectively controlling the cross-section of the first fluid plane. A second fluid delivery system is secured to the frame and directs a second plane of fluid into the interior region of the frame. The second fluid delivery system includes a plurality of flow regulating elements that are actuatable for selectively controlling the cross-section of the second fluid plane. A controller actuates the plurality of flow regulating elements of the first and second fluid delivery systems to control the cross-section of the first fluid plane and the cross-section of the second fluid plane in real-time.

In accordance with another aspect of the present invention, an interactive fluid delivery system includes one or more tubular members in fluid communication with a fluid source. Each tubular member has a plurality of openings. A flow regulating element extends through each opening in the tubular member. An output of the flow regulating elements collectively forms a plane of fluid that flows away from the tubular member. A controller actuates the flow regulating elements to control the cross-section of the fluid plane to form at least one of an image and text in the fluid plane. At least one motion sensor senses movement around the fluid plane and provides a motion sensor signal to the controller. The controller, in response to the motion sensor signal, controls the cross-section of the fluid plane.

Other objects and advantages and a fuller understanding of the invention will be had from the following detailed description of the preferred embodiments and the accompanying drawings.

BRIEF DESCRIPTION OF THE DRAWINGS

FIG. 7 is a schematic illustration of a controller for controlling the first and second fluid planes;

FIG. 11 is a schematic illustration of an interactive apparatus secured to a ceiling of a room.

DETAILED DESCRIPTION

Figure 1:
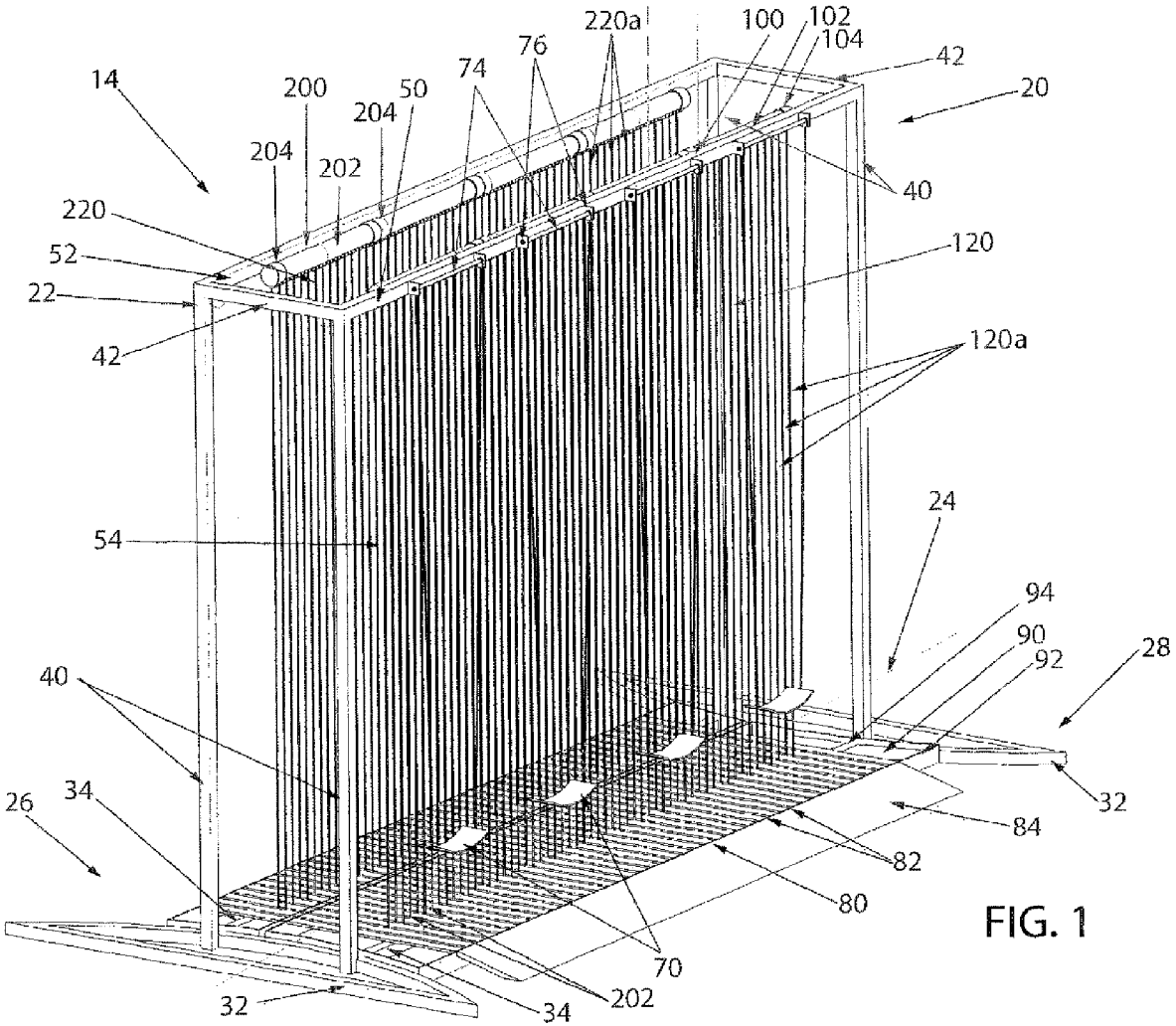
FIG. 1 is a schematic illustration of an interactive apparatus in accordance with the present invention.

The invention relates to an interactive apparatus and, more specifically, relates to a swing set having at least one interactive fluid plane through which users of the swing set pass. FIGS. 1-5B illustrate an interactive apparatus 14 in accordance with an embodiment of the present invention. In FIGS. 1-5B, the interactive apparatus 14 includes a swing set 20, although those skilled in the art will appreciate that the interactive apparatus may alternatively include other playground equipment such as slides, teeter totters, etc.

The swing set 20 includes a frame 22 extends from a first end 26 to a second end 28. An axis 24 is shown extending between the first end 26 and the second end 28 of the frame 22 for purposes of reference in describing the apparatus 14 and spatial relationships between features of the apparatus. The frame 22 includes a pair of feet 32, a plurality of vertical support members 40 secured to the feet, and a plurality of horizontal support members 50, 52 that extends between and interconnect the vertical support members. The frame 22 has a durable, lightweight construction to facilitate manufacturing. The frame 22, for example, may be made of a series of interconnected tubes constructed of a durable, weather-resistant material such as metals, polymers or combinations thereof.

The feet 32 have a configuration suitable for stabilizing the frame 22 on ground such as pavement, grass or wood chips. The feet 32 may, for example, exhibit a hemispherical or polygonal shape in order to provide a wide base over which the weight of the interactive apparatus 14 is evenly distributed. One or more reinforcing members 34 connect the feet 32 to one another in order to further stabilize the frame 22. The vertical support members 40 are secured to or integrally formed with the feet 32. The vertical support members 40 extend substantially parallel to one another and substantially perpendicular to the axis 24. Alternatively, the vertical support members 40 may extend at an angle relative to one another and/or at an angle relative to the axis 24 (not shown). As shown in FIG. 1, a pair of vertical support members 40 extends from the foot 32 at the first end 26 of the frame 22 and a pair of vertical support members extends from the foot at the second end 28 of the frame. Each pair of vertical support members 40 at the ends 26, 28 of the frame 22 may be interconnected or secured to one another by one or more straight or arcuate reinforcing members 42 to inhibit or prevent relative movement between the vertical support members.

First and second horizontal support members 50, 52 extend between the first end 26 and the second end 28 of the frame 22 and connect the vertical support members 40 at the first end of the frame to the vertical support members at the second end of the frame. The horizontal support members 50, 52 are vertically spaced from the reinforcing members 34 and extend substantially parallel to the axis 24 and substantially perpendicular to the vertical support members 40. The horizontal support members 50, 52 are equidistantly spaced on either side of the axis 24, although other spacing configurations may be used. The horizontal support members 50, 52, vertical support members 40, and the reinforcing members 34 or ground cooperate to define an interior region 54 of the frame 22.

Figure 2:
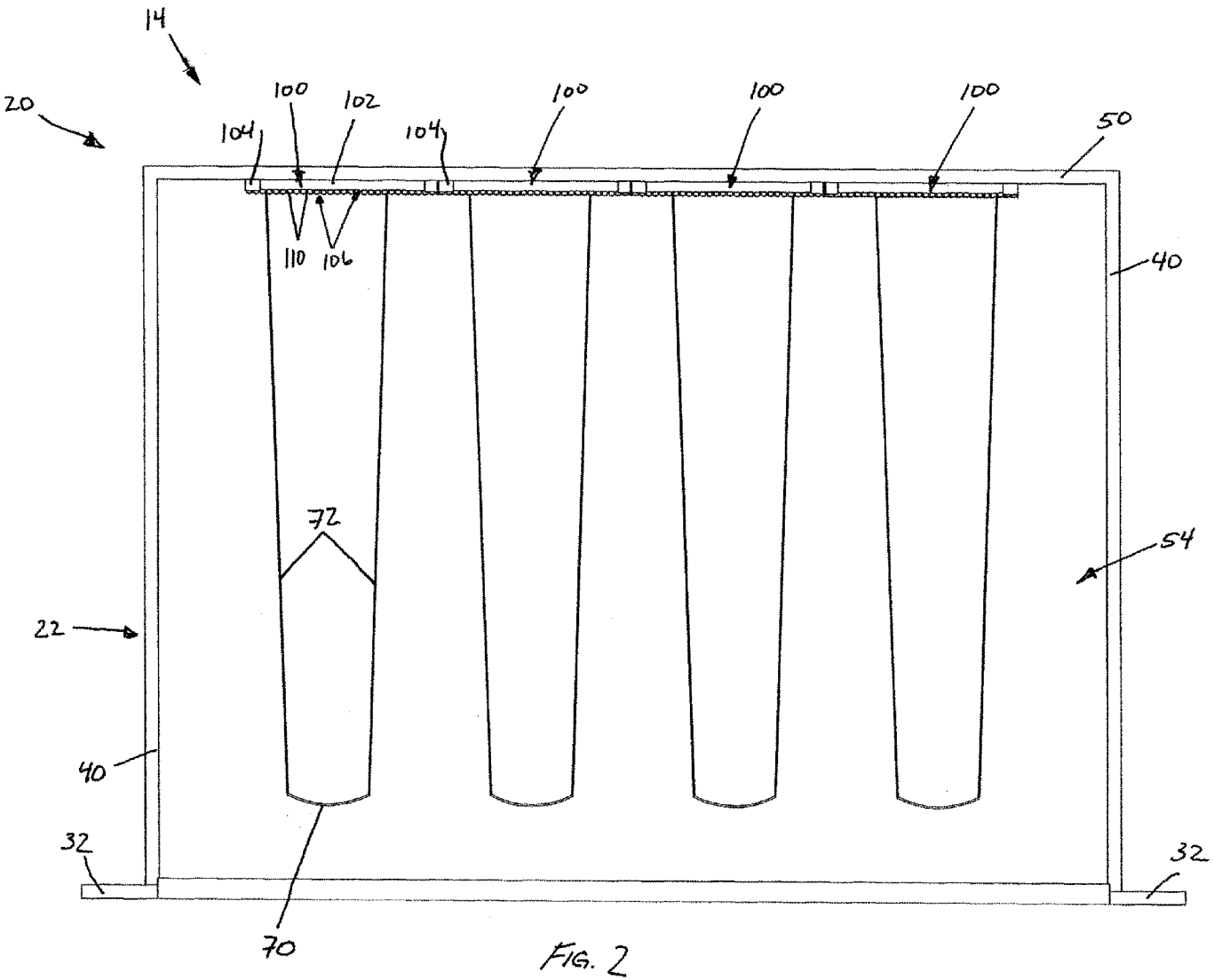
FIG. 2 is a front sectional view of a swing set of the interactive apparatus of FIG. 1.
Figure 3:
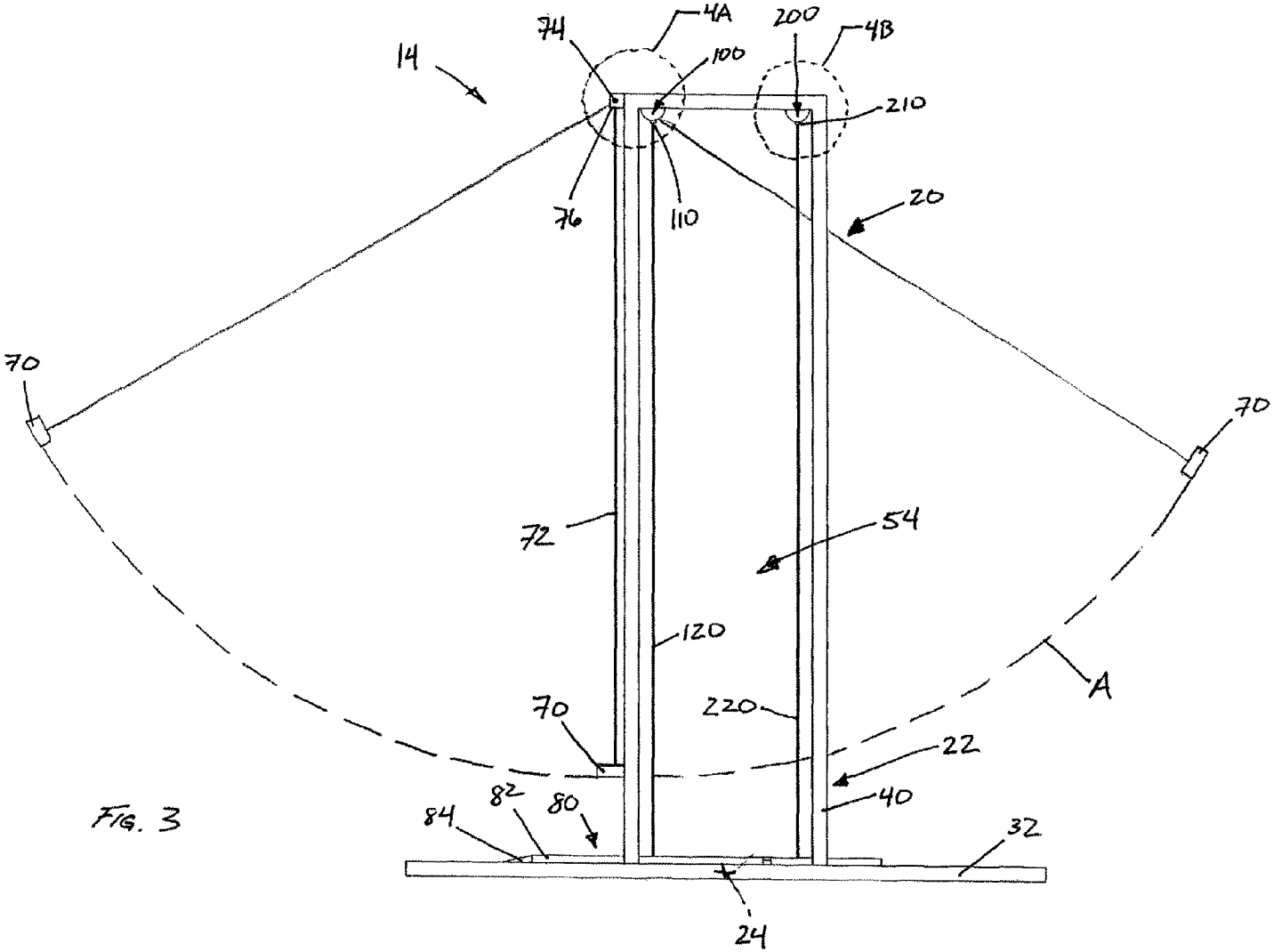
FIG. 3 is a side view of the swing set of FIG. 1.

As shown in FIGS. 1-3, one or more swings 70 are suspended from the first horizontal support member 50 and are initially positioned within the interior region 54 of the frame 22. Each swing 70 is connected to a pair of cables 72 that connect the swing to a swing axle 74 secured to the first horizontal support member 50. In particular, each end of the swing axle 74 is supported rotation relative to the first horizontal support member 50 by a mounting tab 76 (see also FIG. 4A) secured to or integral with the first horizontal support member. The swing axle 74 extends substantially parallel to the axis 24. The swing axle 74 allows the swing 70 to travel via the cables 72 through an arc indicated by arrow A (FIG. 3) for movement into and out of the interior region 54 of the frame 22. Each swing axle 74 and corresponding mounting tab 76 may be rigidly secured to or moveable along the first horizontal support member 50 to adjust the position of the axles and, thus, the position of the seats 70 relative to the frame 22. Furthermore, each swing axle 74 may be releasably connected to the horizontal support member 50 to remove the swing 70 from the frame 22.

A platform 80 (see FIGS. 1 and 5) is secured to the frame 22 for helping an individual access the swing 70 for use. The platform 80 has a generally trapezoidal shape and includes a series of planar members 82 and angled members 84. The planar members 82 are spaced from the ground and reside in a plane that extends substantially parallel to the horizontal support members 50, 52. The angled members 84 engage the ground and reside in a plane that extends at an angle relative to the horizontal support members 50, 52. The platform 80 is made out of spaced-apart slats made of, for example, wood, metal or plastic that are secured to and the reinforcing members 34. Alternatively, the platform 80 may constitute a metal grid or be formed from an elastomeric material such that the platform assists liftoff of the user to the swings 70 similar to a trampoline (not shown). The platform 80 is configured to place the planar members 82 in a position relative to the swings 70 that allows individual, e.g., children, to readily get into and out of the swings.

As shown in FIG. 1, a drain 90 is secured to the reinforcing members 34 and the feet 32. The drain 90 is positioned beneath the platform 80 and overlies the ground. The drain 90 includes a rectangular drain box 92 made from water resistant materials. A seal 94 lines the drain box 92 provides a liquid-tight seal in the drain 90. The drain 90 collects liquid from the interactive apparatus 14 and drains the liquid via a fitting (not shown) to a designated drain receptacle such as a storage tank or sewer drain. Alternatively, the drain 90 collects liquid and recycles it through the interactive apparatus 14 (not shown). Furthermore, it will be understood that the drain 90 may be omitted (not shown).

The interactive apparatus 14 further includes one or more first fluid delivery systems 100 secured to the first horizontal support 50 for delivering fluid to the interior region 54 of the frame 22 along a first fluid plane 120 (FIGS. 1 and 3). The term "fluid" as used herein may designate any desirable fluid that can be obtained from a source and directed through the first fluid delivery system 100 and into the first fluid plane 120. The fluid may, for example, constitute water. The water may be untreated or dyed to exhibit a desired color. The water may include additives that increase or decrease the surface tension and/or viscosity of the water.

Figure 5:
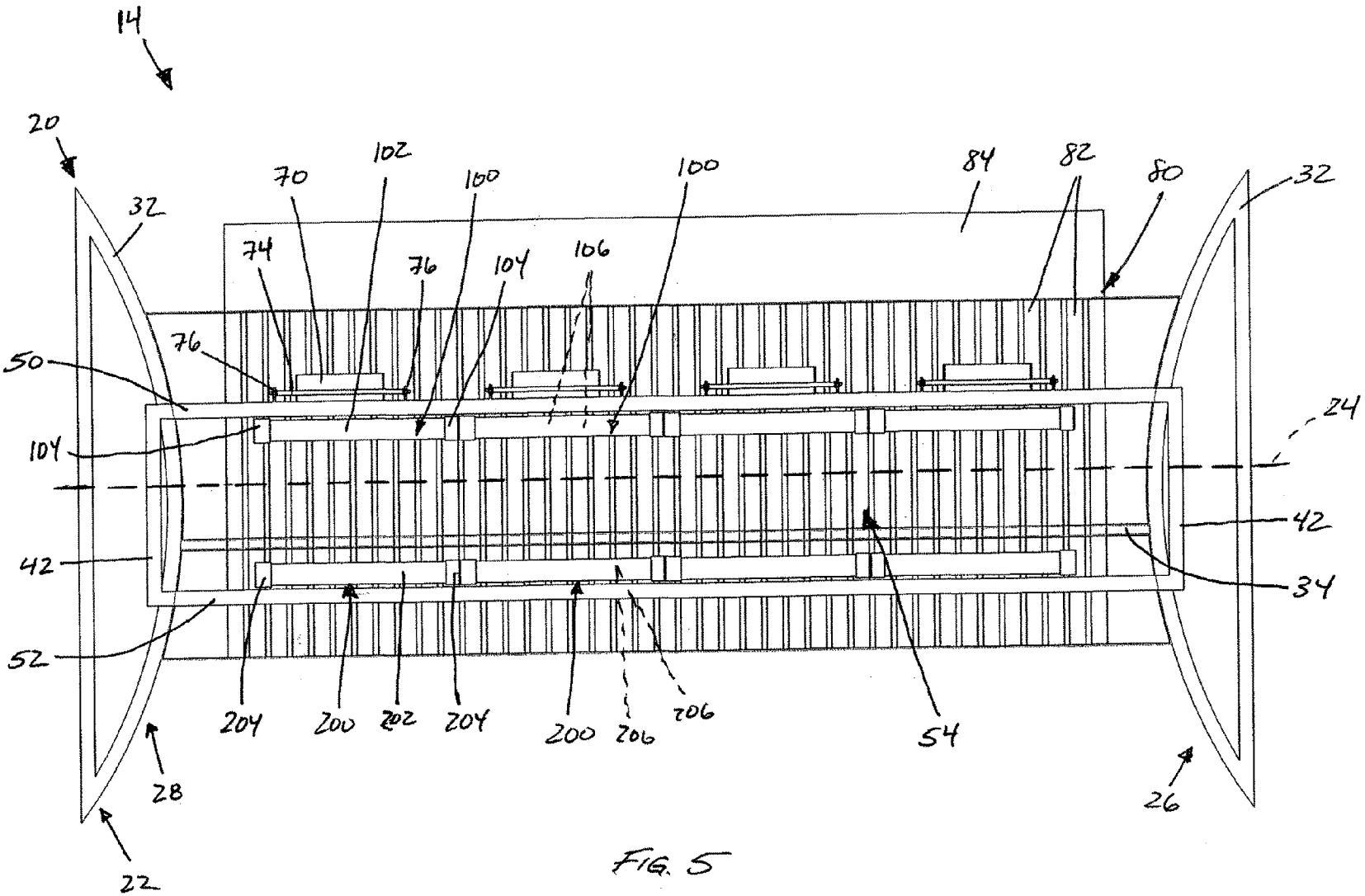
FIG. 5 is a top view of the swing set of FIG. 1.

Each first fluid delivery system 100 may be secured to a side of the first horizontal 50 member facing the second horizontal member 52 or a side of the first horizontal member facing away from the second horizontal member. As shown in FIG. 5, each of the first fluid delivery systems 100 is secured to the interior region-facing side, i.e., the right side as viewed in FIG. 5, of the first horizontal member 50 and each of the swing axles 74 for the swings 70 is secured to the exterior-facing side, i.e., the left side as viewed in FIG. 5, of the first horizontal member.

Figure 4A:
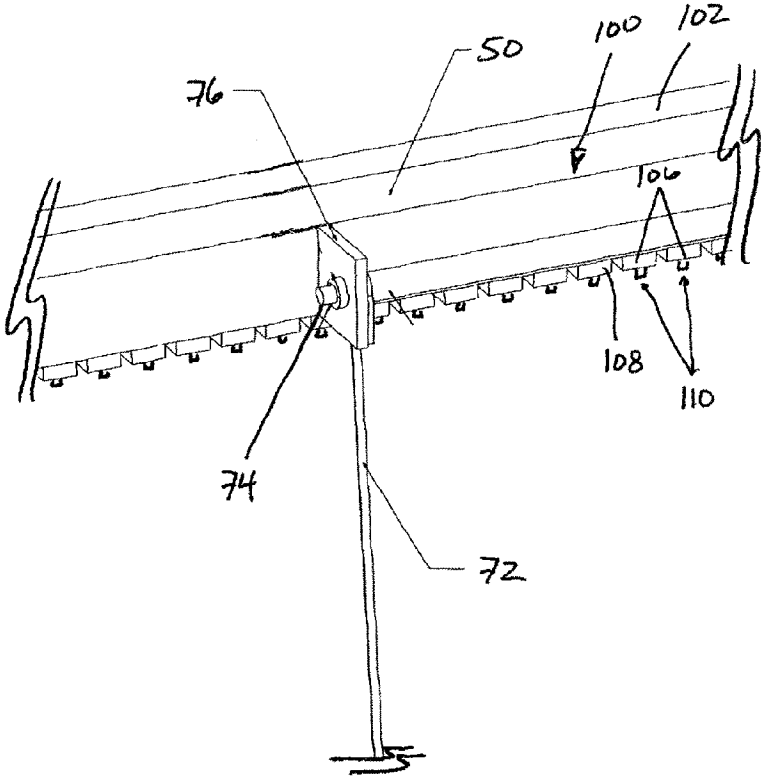
FIG. 4A is an enlarged view of a first portion of the interactive apparatus of FIG. 3.

Referring to FIG. 4A, each first fluid delivery system 100 includes a tubular member 102 that has an end cap 104 provided at each end. Each tubular member 102 may have a unitary construction or may be formed from several separate tubes secured to one another. If more than one first fluid delivery system 100 is provided, the end caps 104 of each first fluid delivery system may be connected to one another to provide fluid communication between the first fluid delivery systems while preventing fluid leakage through the first fluid delivery systems.

A plurality of flow regulating elements 106, such as solenoid valves, is positioned along the tubular member 102, although those skilled in the art will contemplate that any flow regulating structure could be used in accordance with the present invention. The flow regulating elements 106 are aligned within one another along the tubular member 102 in a direction that extends substantially parallel to the axis 24. The flow regulating elements 106 may be spaced from one another or may be positioned abutting one another. Collectively, the flow regulating elements 106 may extend along the entire length of the tubular member 102 or along only a portion of the length.

As shown in FIGS. 2 and 4, a portion 108, e.g., an outlet orifice or tube, of each flow regulating element 106 extends downward and through a corresponding opening 112 in the tubular member 102 towards the interior region 54 of the frame 22. The portion 108 is attached to or integral with an aerator 110 that receives fluid from within the tubular member 102 and directs the fluid out of the tubular member in a desired manner, e.g., as a uniform stream that flows towards the interior region 54 of the frame 22. Alternatively, the aerators 110 are omitted (not shown) and fluid flows directly out of the portion 108 towards the interior region 54 of the frame 22. The flow regulating elements 106 and aerators 110 cooperate to direct fluid passing through the tubular member 102 in a downward direction out of the tubular member and into the interior region 54 of the frame 22 along the first fluid plane 120. In other words, the flow regulating elements 106 and aerators 110 define a plurality of parallel fluid streams arranged in a planar fashion to form what is referred to herein as the "first fluid plane 120".

The end cap 104 at one end of the tubular member 102 is connected to a fitting (not shown) for fluidly connecting the first fluid delivery system 100 with a liquid source, e.g., storage tank, hose, etc. The flow regulating elements 106 are secured within the openings 112 in the tubular member 102 in a fluid-tight manner to prevent fluid from exiting the tubular member through the openings without also passing through the flow regulating elements and associated aerators 110.

A series of first fluid delivery systems 100 may be connected together along the first horizontal support member 50 such that the first fluid plane 120 extends along a portion or all of the length of the first horizontal support member between the first and second ends 26, 28 of the frame 22. Those skilled in the art, however, will appreciate that a single fluid delivery system 100 may span the entire length of the first horizontal support member 50 in accordance with the present invention. Although four first fluid delivery systems 100 are shown in FIG. 5, more or fewer first fluid delivery systems may be provided to accommodate a frame 22 having any length. The modular construction of the first fluid delivery systems 100 allows any number of first fluid delivery systems to be secured to one another for accommodating a swing set 20 or other playground equipment of any size or shape. The number and positioning of the first fluid delivery systems 100 along the first horizontal support member 50 may correspond with the number and position of the swings 70 provided along the first horizontal support member. In other words, a first fluid delivery system 100 may be provided directly above some or all of the swings 70 and along the first horizontal support member 50.

The first fluid delivery systems 100 may adjoin one another or may be aligned but spaced from one another in a direction extending parallel to the axis 24 to form a continuous or discontinuous first fluid plane 120. Alternatively, the first fluid delivery systems 100 may be positioned along both sides of the first horizontal support member 50 relative to the axis 24 of the frame such that the first fluid plane 120 constitutes a series of individual fluid planes extending parallel to the axis and positioned along both sides of the first horizontal support member (not shown). Regardless of the orientation and number of first fluid delivery systems 100, each first fluid delivery system is in fluid communication with every other first fluid delivery system.

One or more second fluid delivery systems 200 is secured to the second horizontal supply member 52 for delivering fluid to the interior region 54 of the frame 22 along a second fluid plane 220 that extends substantially parallel to the first fluid plane 120 and the axis 24 (FIGS. 1 and 3). Alternatively, the first fluid plane 220 extends at an angle relative to the first fluid plane 120 (not shown). The fluid passing through the second fluid delivery systems 200 may be the same as or different from the fluid passing through the first fluid delivery systems 100 at any given time.

The number and positioning of the second fluid delivery systems 200 along the second horizontal support member 52 may correspond with the number and positioning of the first fluid delivery systems 100 and/or the swings 70 along the first horizontal support member 50. As shown in FIG. 5, each of the four first fluid delivery systems 100 secured to the first horizontal member 52 has a corresponding second fluid delivery system 200 secured to the second horizontal support member 52 and aligned with the associated first fluid delivery system in a direction substantially perpendicular to the axis 24.

Figure 4B:
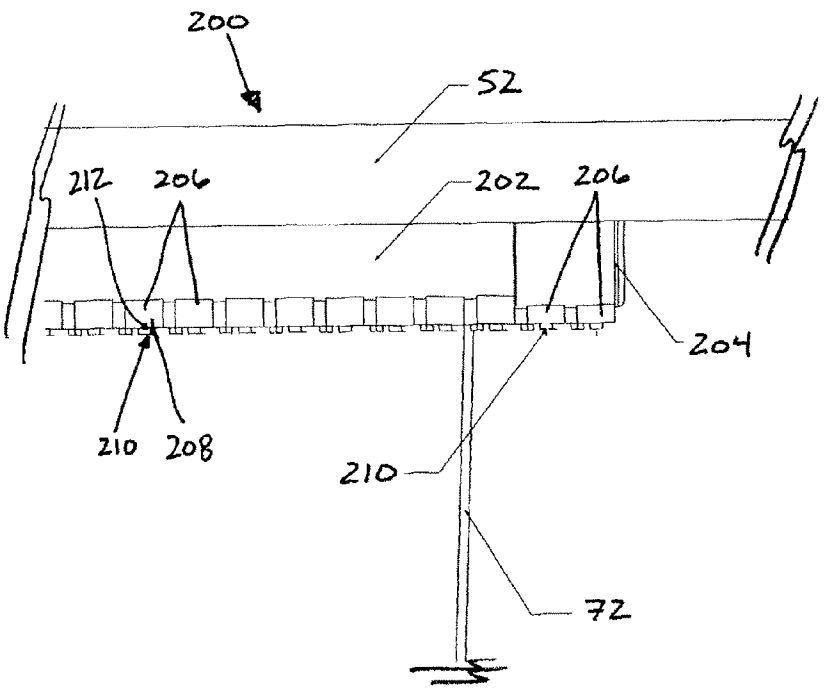
FIG. 4B is an enlarged view of a second portion of the interactive apparatus of FIG. 3.

As shown in FIG. 4B, each second fluid delivery system 200 has a construction that is substantially identical to the construction of the first fluid delivery systems 100. In particular, each second fluid delivery system 200 includes a tubular member 202 that has ends covered with end caps 204. A series of flow regulating elements 206, such as solenoid valves, are positioned along the tubular member 202. Each of the flow regulating elements 206 includes a portion 208 that extends through an associated opening 212 in the tubular member 202. The portion 208 is connected with an aerator 210 for directing fluid downward into the interior region 54 of the frame 22 along the second fluid plane 220. In other words, the flow regulating elements 206 and aerators 210 define a plurality of parallel fluid streams arranged in a planar fashion to form what is referred to herein as the "second fluid plane 220".

Figure 6A:
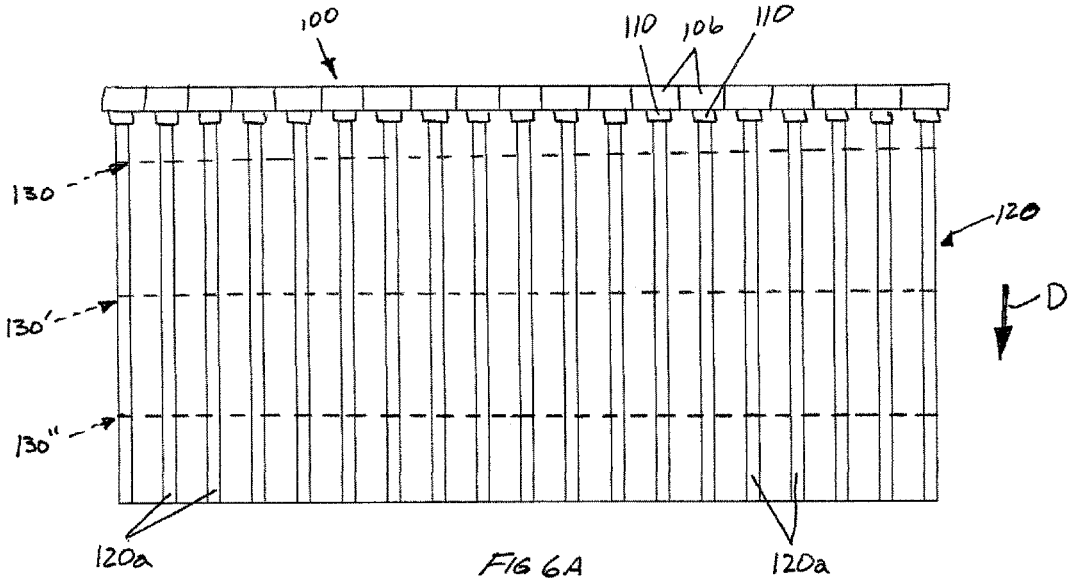
FIG. 6A is a schematic illustration of a first fluid plane of the interactive apparatus of FIG. 1.

As shown in FIG. 6A, the first fluid plane 120 is defined as the collective sum of individual fluid portions 120*a* originating from and characterized by the aerators 110 in the first fluid delivery systems 100. For simplicity, a first fluid plane 120 having nineteen portions 120*a* is illustrated in FIG. 6A, although the first fluid plane may have more or fewer portions correlating with the number of aerators 110 in the first fluid delivery systems 100.

A planar cross-section 130 of the first fluid plane 120 is defined in a direction extending perpendicular to the downward flow path of the fluid, indicated generally by arrow D, towards the drain 90, i.e., a direction extending parallel to the axis 24. The cross-section 130 of the first fluid plane 120 constitutes the sum of the fluid outputs of all flow regulating elements 106 in the first fluid delivery systems 100, i.e., the plurality of parallel fluid streams arranged in a planar fashion, at a single time and in a single plane that extends perpendicular to the first fluid plane. Every particular cross-section 130 of the first fluid plane 120 originates at the output of the aerators 110 of the flow regulating elements 106 and maintains the same profile as it travels downward under the influence of gravity towards the individual in the swing 70 and, ultimately, to the drain 90. One cross-section 130 of the first fluid plane 120 is illustrated at a first subsequent time and a second subsequent time by phantom lines 130' and 130", respectively, after originating at the aerators 110 of the flow regulating elements 106.

Figure 6B:
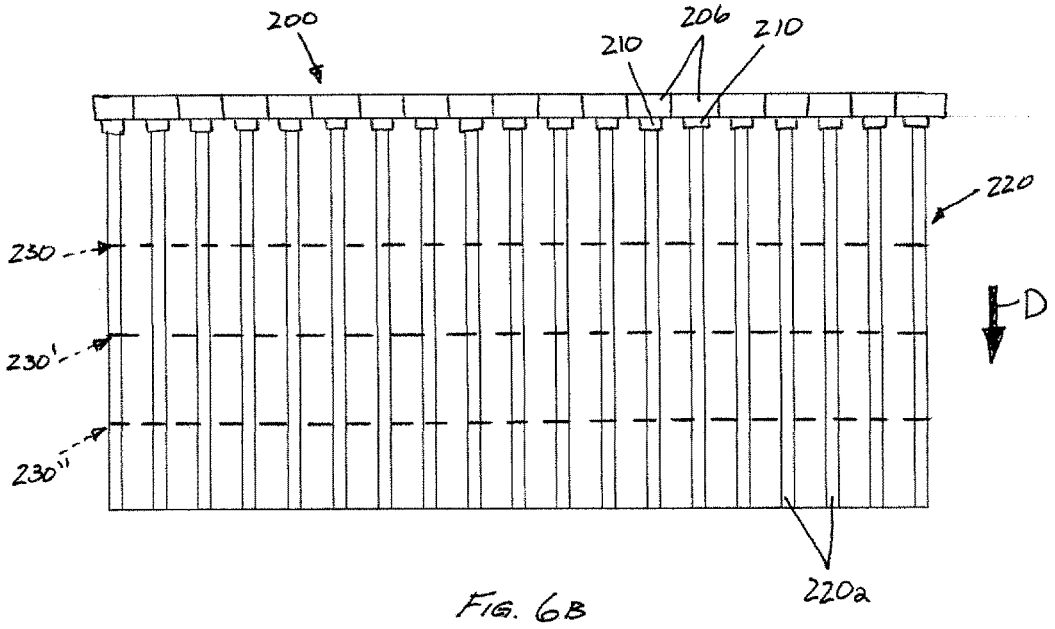
FIG. 6B is a schematic illustration of a second fluid plane of the interactive apparatus of FIG. 1.

As shown in FIG. 6B, the second fluid plane 220 is similarly defined as the collective sum of individual fluid portions 220*a* originating from and characterized by the aerators 210 in the second fluid delivery systems 200. For simplicity, a second fluid plane 220 having nineteen portions 220*a* is illustrated in FIG. 6B, although the second fluid plane may have more or fewer portions correlating with the number of aerators 210 in the second fluid delivery systems 200.

A planar cross-section 230 of the second fluid plane 220 is defined in a direction extending perpendicular to the downward flow path of the fluid, indicated generally by arrow D, towards the drain 90, i.e., a direction extending parallel to the axis 24. The cross-section 230 of the second fluid plane 220 constitutes the sum of the fluid outputs of all flow regulating elements 206 in the second fluid delivery systems 200, i.e., the plurality of parallel fluid streams arranged in a planar fashion, at a single time and in a single plane that extends perpendicular to the second fluid plane. Every particular cross-section 230 of the second fluid plane 220 originates at the output of the aerators 210 of the flow regulating elements 206 and maintains the same profile as it travels downward under the influence of gravity towards the individual in the swing 70 and, ultimately, to the drain 90. One cross-section 230 of the second fluid plane 220 is illustrated at a first subsequent time and a second subsequent time by phantom lines 230' and 230", respectively, after originating at the aerators 210 of the flow regulating elements 206.

In accordance with the present invention, the flow regulating elements 106, 206 in the first and second fluid delivery systems 100, 200 are electrically connected to a controller 300 (FIG. 7) for selectively controlling fluid flow through each of the flow regulating elements in real-time. In particular, the flow regulating elements 106, 206 in each fluid delivery system 100, 200 are wired to one or more junction boxes (not shown) secured to a portion of the frame 22, e.g., the horizontal support members 50, 52. The junction boxes, in turn, route wiring through the vertical support members 40 and to the controller 300 and a power supply 310. The controller 300 selectively actuates the flow regulating elements 106, 206 to vary the cross-sections 130, 230 of the first and/or second fluid planes 120, 220, respectively, as the fluid exits the fluid delivery systems 100, 200 and heads towards the user of the swings 70 and, ultimately, towards the drain 90. The controller 300 includes a timer 320 to provide precisely timed actuation of each flow regulating element 106, 206 in the first and second fluid delivery systems 100, 200, respectively. The controller 300 may include wireless technology that allows the controller to be programmed via a mobile device 330, such as a cellular phone or mobile computer, and respond in real-time.

Figure 8A:
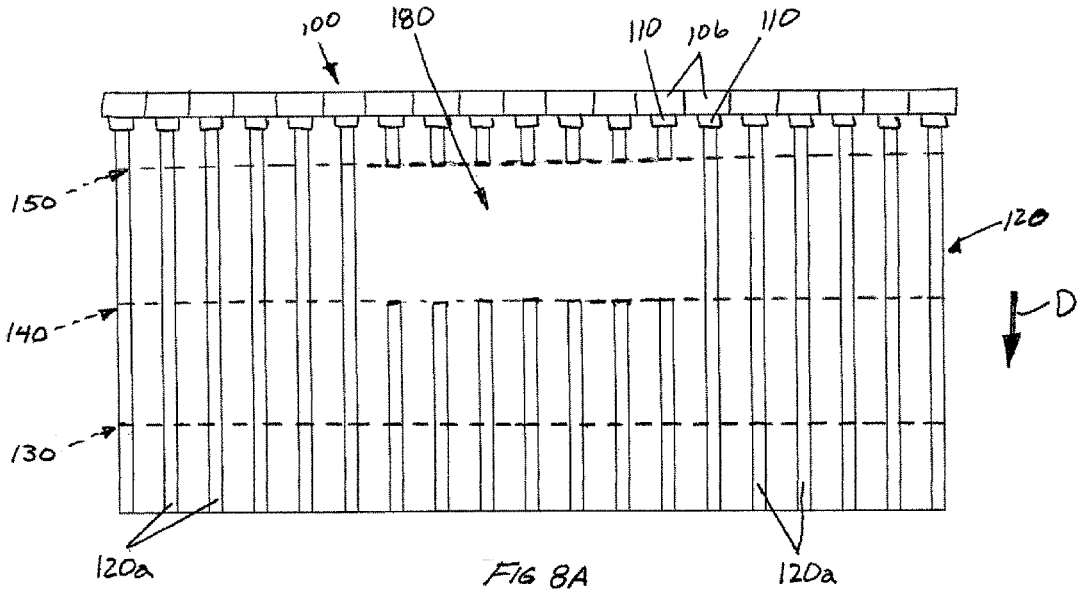
FIG. 8A is a schematic illustration of the first fluid plane of the interactive apparatus of FIG. 1 depicting an image.

Since each of the flow regulating elements 106 can be selectively actuated by the controller 300, the fluid output of each fluid regulating element and, thus, the flow output of each aerator 110 can be precisely regulated in order to produce any desirable cross-section 130 for the first fluid plane 120 at any given time. Furthermore, since fluid is continually supplied to the first fluid delivery systems 100, the cross-section 130 of the first fluid plane 120 may be continually changed in order to create the appearance of scrolling text or an image 180, e.g., a rectangle as shown in FIG. 8A, flowing from the first fluid delivery systems 100. "Scrolling" as used herein may occur in a vertical manner, a horizontal manner or both. In operation, the controller 300 may selectively actuate, i.e., open or close, a predetermined number of flow regulating elements 106 in one or more of the first fluid delivery systems 100 in order to control the flow profile of successive cross-sections—illustrated by numerals 140, 150—of fluid defining the first fluid plane 120. Using the timer 320, successive cross-sections 140, 150 may be established at constant time intervals or varying time intervals depending on the complexity and profile of the scrolling image 180 or text.

As shown in FIG. 8A, all the flow regulating elements 106 are initially opened to form the first cross-section 130. After a predetermined time, at the second cross-section 140 some flow regulating elements 106 in the middle of the first fluid delivery system 100 are closed such that no fluid flows through the middle portion of the first fluid delivery system. Closure of these flow regulating elements 106 at the second fluid cross-section 140 forms a void or air space within the first fluid plane 120. The middle flow regulating elements 106 are held closed, for a predetermined time until a third cross-section 150 is defined in which all the flow regulating elements are opened, thereby closing the void or air space in the first fluid plane 120 to define a rectangular shape or image 180 in the first fluid plane. All of the flow regulating elements 106 may remain open after the third cross-section 150 until it is desirable to alter the first fluid plane 120 again.

The precision of control of the cross-section of the first fluid plane 120 at any given time is dictated by the number and spacing of the aerators 110 within the first fluid delivery systems 100. For instance, more aerators 110 per unit length of the first fluid delivery system 100 results in a first fluid plane 120 defined by more fluid outputs and, thus, a fluid plane having more portions **120*a* that can be altered by the controller 300. Moreover, by reducing the time frame in between which the cross-section of the first fluid plane 120 changes, the complexity and resolution of the scrolling image 180** may be increased.

Figure 8B:
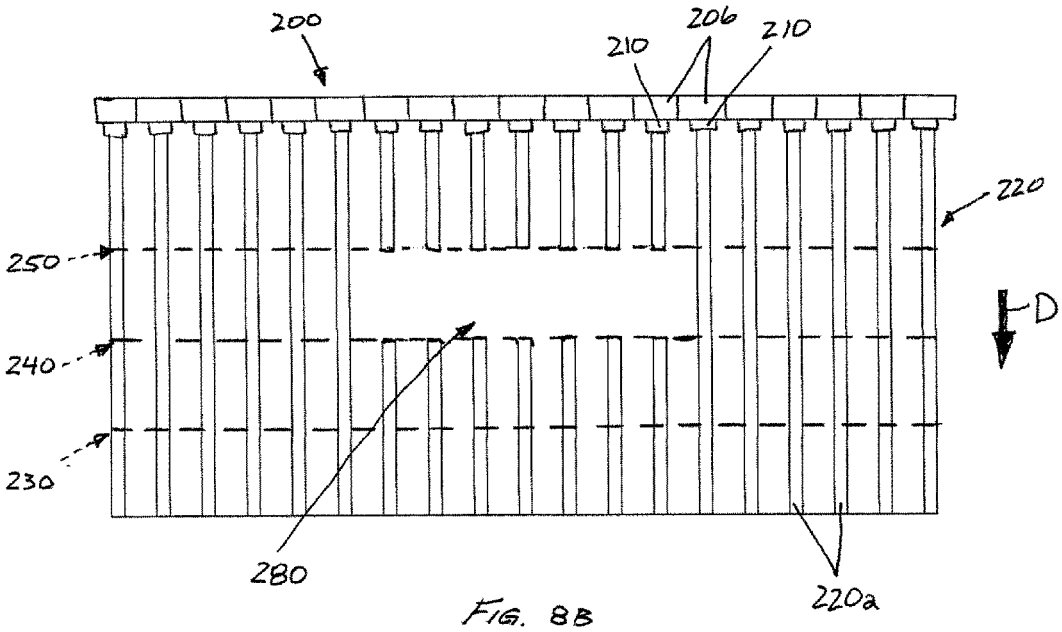
FIG. 8B is a schematic illustration of the second fluid plane of the interactive apparatus of FIG. 1 depicting an image.

Likewise, since each of the flow regulating elements 206 can be selectively actuated by the controller 300, the fluid output of each fluid regulating element and, thus, the flow output of each aerator 210 can be precisely regulated in order to produce any desirable cross-section 230 for the second fluid plane 220 at any given time. Furthermore, since fluid is continually supplied to the second fluid delivery systems 200, the cross-section 230 of the second fluid plane 220 may be continually changed in order to create the appearance of scrolling text or an image 280, e.g., a rectangle as shown in FIG. 8B, flowing from the second fluid delivery systems 200. In operation, the controller 300 may selectively actuate, i.e., open or close, a predetermined number of flow regulating elements 206 in one or more of the second fluid delivery systems 200 in order to control the flow profile of successive cross-sections—illustrated by numerals 240, 250—of fluid defining the second fluid plane 220. Using the timer 320, successive cross-sections 240, 250 may be established at constant time intervals or varying time intervals depending on the complexity and profile of the scrolling image 280 or text.

As shown in FIG. 8B, all the flow regulating elements 206 are initially opened to form the second cross-section 230. After a predetermined time, at the second cross-section 240 some flow regulating elements 206 in the middle of the second fluid delivery system 200 are closed such that no fluid flows through the middle portion of the second fluid delivery system. Closure of these flow regulating elements 206 at the second fluid cross-section 240 forms a void or air space within the second fluid plane 220. The middle flow regulating elements 206 are held closed for a predetermined time until a third cross-section 250 is defined in which all the flow regulating elements are opened, thereby closing the void or air space in the second fluid plane 220 to define a rectangular shape or image 280 in the second fluid plane. All of the flow regulating elements 206 may remain open after the third cross-section 250 until it is desirable to alter the second fluid plane 220 again.

The precision of control of the cross-section of the second fluid plane 220 at any given time is dictated by the number and spacing of the aerators 210 within the second fluid delivery systems 200. For instance, more aerators 210 per unit length of the second fluid delivery system 100 results in a second fluid plane 220 that is defined by more fluid outputs and, thus, a fluid plane having more portions **220*a* that can be altered by the controller 300. Moreover, by reducing the time frame in between which the cross-section of the second fluid plane 220 changes, the complexity of the scrolling image 280** may be increased.

Referring to FIG. 3, due to the construction of the swing set 2Q the arc A of each swing 70 is configured to interact with the first fluid delivery system 100 and the second fluid delivery system 200. In particular, during movement of each swing 70 through the arc A, the swing passes directly underneath the aerators 110 of the first fluid delivery system 100 and the aerators 210 of the second fluid delivery system 200 while the swing moves into and out of the interior region 54 of the frame 22. Therefore, as each swing 70 travels through the arc A, the swing passes into and out of the first fluid plane 120 and the second fluid plane 220 in one direction and then into and out of the second fluid plane and the first fluid plane in the other, reverse direction. Accordingly, a user of the swing 70 will pass repeatedly forward and backward through the first and second fluid planes 120, 220 during use of the swingset 20.

The controller 300 may receive feedback from one or more motion sensors 340 on the swing set 20 to control the scrolling images 180, 280 such that the images interact with the user(s) of the swing(s) 70. The motion sensors 340 are positioned along or in proximity with the frame 22 for sensing motion of the swing 70 or the user of the swing as the swing passes into and out of the interior region 54 of the frame. For example, one or more motion sensors 340 are associated with each fluid directing structure 100, 200. The motion sensors 340 sense movement and provide a signal indicative of that movement to the controller 300 such that the controller may control the cross-sections 130, 230 of the fluid planes 120, 220 in response to the motion sensor signals. For example, the controller 300 may, in response to the motion sensor 340 signals, operate the first fluid delivery systems 100, 200 to produce scrolling shapes or images 180, 280 that provide a break or void, i.e., an absence of liquid, in the fluid planes 120, 220 sufficient to enable the user(s) to swing through the fluid planes without coming into contact with the liquid of the fluid planes.

Due to this construction, the swing set 20 of the present invention may be used to create any desirable scrolling images 180, 280, through which the user of the swings 70 swing into and out of during use of the swing set 20. The scrolling image may be exhibited in the first fluid plane 120, the second fluid plane 220, both of the fluid planes, or neither of the fluid planes. The scrolling image may, for example, depict text, pictures, designs or the like. Furthermore, the first and second fluid delivery systems 100, 200 may be configured to provide a single scrolling image 180 on the first and/or second fluid planes 120, 220 or the first and second fluid delivery systems may provide multiple images that, for example, are aligned with each of the swings 70. The images 180, 280 in the fluid planes 120, 220 may be coordinated with one another, synchronous, random or have any other suitable configuration in accordance with the present invention.

Figure 9:
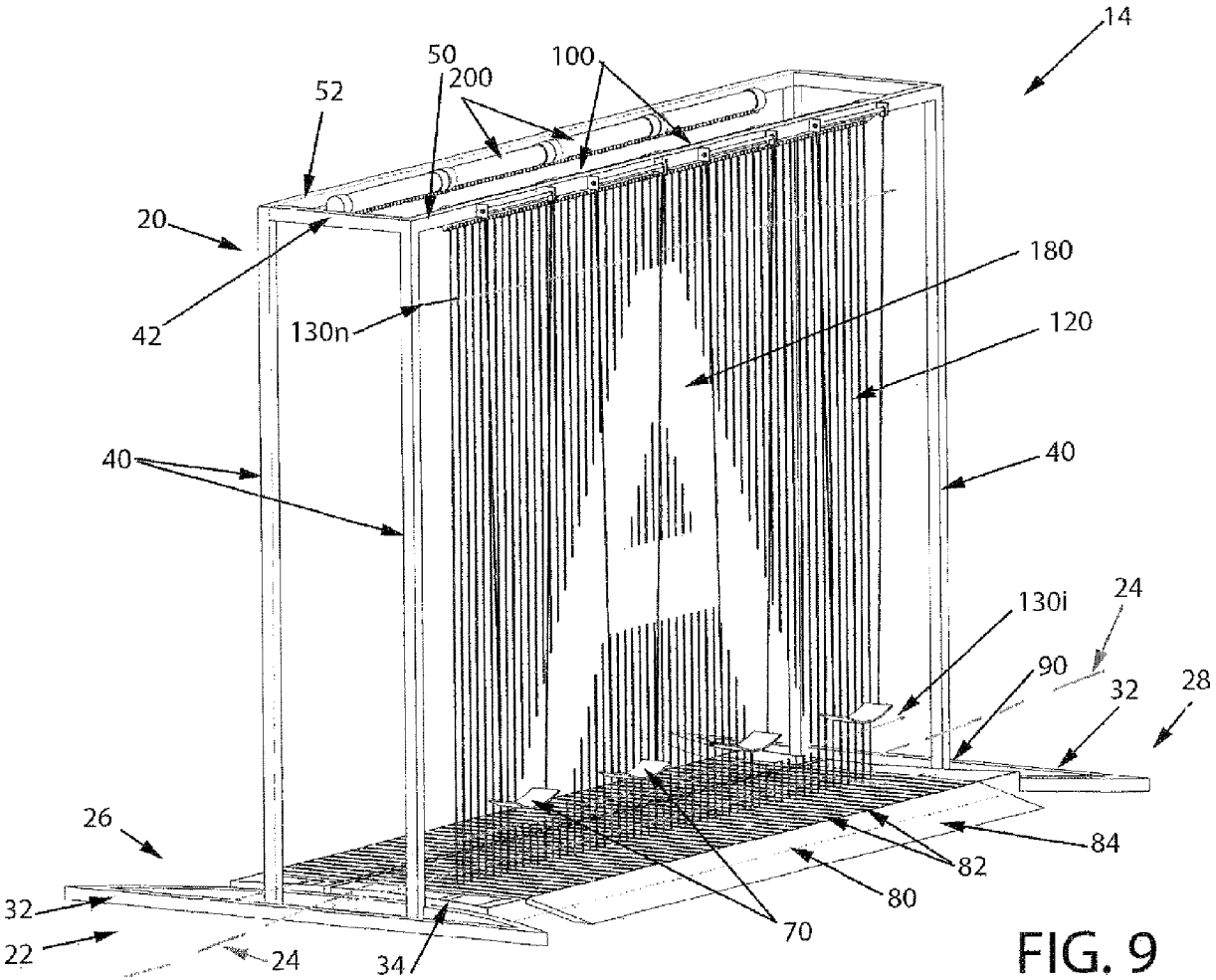
FIG. 9 is a schematic illustration of the interactive apparatus of FIG. 1 depicting an image in the first fluid plane with swings removed.

As shown in FIG. 9, the first fluid delivery systems 100 may be configured to depict a more complex scrolling image 180 of a particular symbol or caricature in the first fluid plane 120 in accordance with the present invention. The scrolling image 180 may repeat based the timer 320 or the image may change periodically, e.g., alternate between the first fluid plane 120 and the second fluid plane 220, based upon predetermined settings in the controller 300. The scrolling image 180 may be produced by providing a first cross-section 130*i* for the first fluid plane 120 and rapidly altering the cross-section at predetermined intervals to produce a large number of different cross-sections, terminating with cross-section 130*n*. The scrolling image 180 is thereby created by summing all the cross-sections from 130*i* to 130*n* of the first fluid plane 120. By increasing the number of cross-sections, i.e., decreasing the time interval, created between cross-section 130*i* and cross-section 130*n*, the complexity and definition of the image 180 may be increased.

Figure 10:
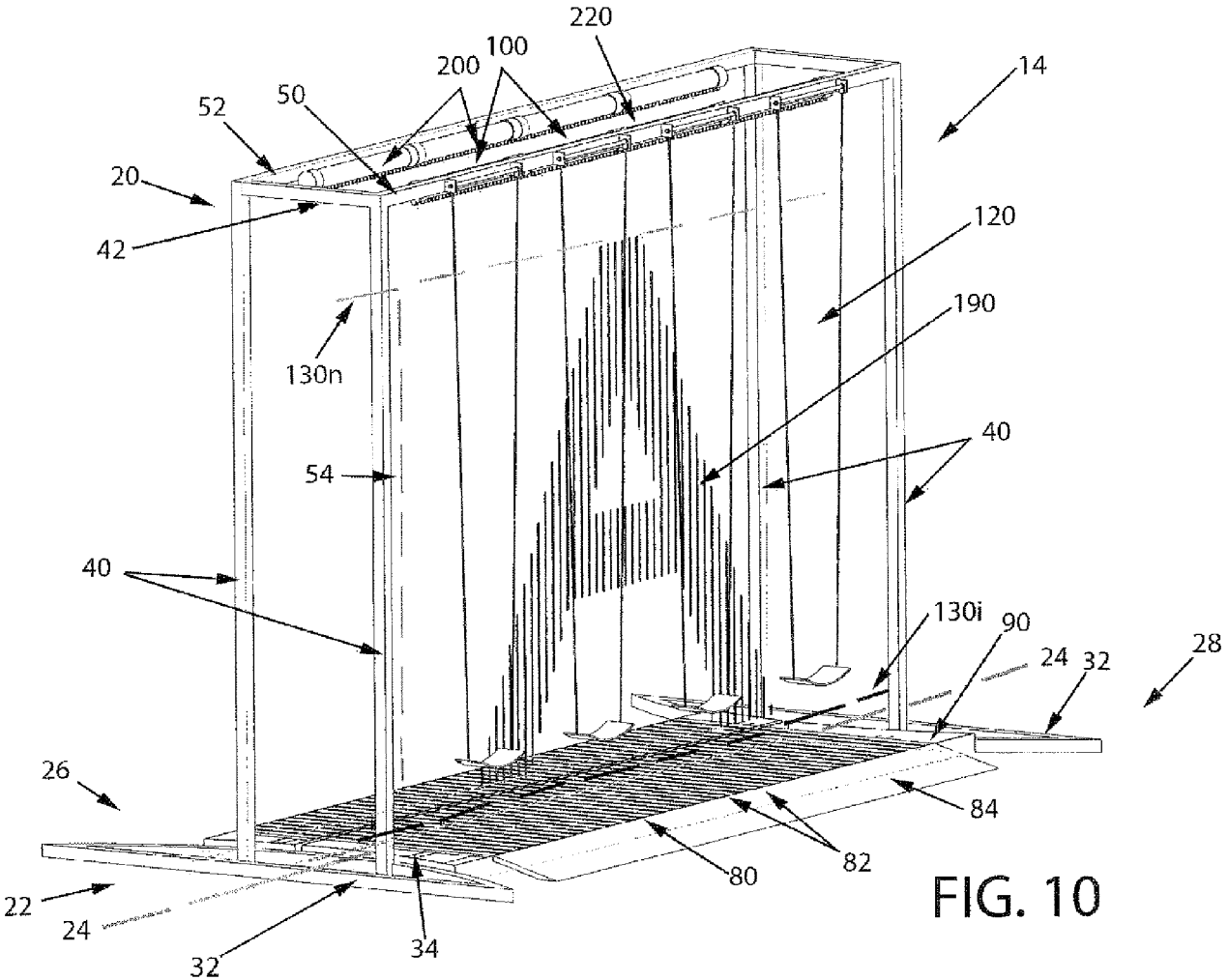
FIG. 10 is a schematic illustration of the swing set of FIG. 1 depicting text in the first fluid plane with swings removed.

The scrolling caricature 180 may be displayed when the swings 70, cables 72, and axles 74 are removed from the first horizontal support member 50 or when the swings, cables, and axles are present (not shown). The same holds true if the scrolling image is configured to exhibit text 190 (FIG. 10).

By using wireless communication in the present invention, an additional level of interactivity between the interactive apparatus 14 and the user is achieved. More specifically, the user may use the mobile device 330 to send text messages or images to the controller 300. The controller 300, in turn, actuates the fluid delivery systems 100, 200 accordingly to depict the sent text messages or images in the fluid planes 120, 220. The input for the text can come through an SMS message sent through the mobile device 330 or through another interface.

Although the interactive apparatus 14 of the present invention is illustrated as including both playground equipment, e.g., a swing set 20, and the fluid delivery systems 100, 200, it will be appreciated that the interactive fluid delivery systems may be operated in isolation without attachment to a particular piece of pre-existing equipment. For example, as shown in FIG. 11, the interactive fluid delivery systems 100 and/or 200 may be suspended from the ceiling 400 of a room or a post embedded in the ground (not shown) while still providing interactive capability with people or objects passing through the fluid planes 120, 220 via the controller 300, motion sensors 340, etc. By "interactive", it is meant that the fluid delivery systems 100, 200 and, more specifically, the fluid planes 120, 220 interact with one or more objects, e.g., people or items such as balls, by reacting to the user or object. More specifically, the fluid planes 120, 220 interact with the object by sensing or reacting to the physical proximity of the object to portions of the fluid delivery systems 100, 200 or to audible commands of the user by altering the cross-section(s) 130, 230 of the fluid plane(s) 120, 220, thereby changing the image 180 or text 190 exhibited therein.

The preferred embodiments of the invention have been illustrated and described in detail. However, the present invention is not to be considered limited to the precise construction disclosed. Various adaptations, modifications and uses of the invention may occur to those skilled in the art to which the invention relates and the intention is to cover hereby all such adaptations, modifications, and uses which fall within the spirit or scope of the appended claims. For example, the swing set may also be provided with lights that may cooperate with portions of the first and/or second fluid planes to further interact with the user of the swing set. Furthermore, the swing set may be provided with more fluid delivery systems in order to provide additional fluid planes with which the user of the swing set interacts.

Having described the invention, the following is claimed:

1. An interactive apparatus comprising:

a frame defining an interior region;

a swing secured to the frame and movable into and out of the interior region; and at least one fluid delivery system secured to the frame for directing a plane of fluid into the interior region of the frame, the fluid delivery system including a plurality of flow regulating and a controller electrically connected to the flow regulating elements for actuating the flow regulating elements to control the cross-section of the fluid plane to form at least one of text, an image, and a void in the fluid plane in real-time in response to movement of the swing into and out of the interior region.

2. The interactive apparatus of claim 1, wherein the controller is wirelessly controlled by a mobile device.

3. The interactive apparatus of claim 1, wherein the at least one fluid delivery system comprises a first fluid delivery system defining a first fluid plane and a second fluid delivery system defining a second fluid plane.

4. The interactive apparatus of claim 3, wherein the controller is electrically connected to the first and second fluid delivery systems for individually actuating the flow regulating elements of the first fluid delivery system to control the cross-section of the first fluid plane and individually actuating the flow regulating elements of the second fluid delivery system to control the cross-section of the second fluid plane.

5. The interactive apparatus of claim 4, wherein the controller actuates the flow regulating elements of the first fluid delivery system to display at least one of text and an image in the first fluid plane in real-time.

6. The interactive apparatus of claim 5, wherein the controller actuates the flow regulating elements of the second fluid delivery system to display at least one of text and an image in the second fluid plane in real-time.

7. The interactive apparatus of claim 4, wherein the controller is wirelessly controlled by a mobile device.

8. The interactive apparatus of claim 3, wherein the frame comprises at least one horizontal cross-member, the first fluid delivery system and the second fluid delivery system extending parallel to the at least one cross-member.

9. The interactive apparatus of claim 8, wherein the first fluid delivery system and the second fluid delivery system are positioned on opposite sides of the swing such that the swing passes through the first fluid plane and the second fluid plane as the swing moves into and out of the interior region of the frame.

10. The interactive apparatus of claim 1 further comprising at least one motion sensor for sensing movement of the swing and providing a motion sensor signal to the controller, wherein the controller, in response to the motion sensor signal, controls the cross-section of the fluid plane.

11. The interactive apparatus of claim 1 further comprising a timer for providing timed actuation of each flow regulating element to form at least one of text, an image, and a void in the fluid plane in real-time.

12. An interactive apparatus comprising:

a frame defining an interior region;

a swing secured to the frame and movable into and out of the interior region;

at least one delivery system secured to the frame for directing a plane of fluid into the interior region of the frame, the fluid delivery system including a plurality of flow regulating elements that are actuatable for selectively controlling the cross-section of the fluid plane; and a controller electrically connected to the at least one fluid delivery system for actuating the plurality of flow regulating elements of the fluid delivery system to control the cross-section of the fluid plane to form at least one of text, an image, and a void in the fluid plane in real-time.

13. The interactive apparatus of claim 12 further comprising at least one motion sensor for sensing movement of the swing and providing a motion sensor signal to the controller, wherein the controller, in response to the motion sensor signal, controls the cross-section of at least one of the first fluid plane and the second fluid plane.

14. The interactive apparatus of claim 12, wherein the controller is wirelessly controlled by a mobile device.

15. An interactive fluid delivery system comprising:

one or more tubular members in fluid communication with a fluid source, each tubular member having a plurality of openings;

a flow regulating element extending through each opening in the tubular member, an output of the flow regulating elements collectively forming a plane of fluid that flows away from the tubular member;

a controller electrically connected to the flow regulating elements and having a timer for actuating the flow regulating elements to control the cross-section of the fluid plane to form at least one of an image and text in the fluid plane;

at least one motion sensor for sensing movement around the fluid plane and providing a motion sensor signal to the controller, wherein the controller, in response to the motion sensor signal, controls the cross-section of the fluid plane in real-time.

16. The interactive fluid delivery system of claim 15, wherein the controller is wirelessly controlled by a mobile device.

* * * * *